US008381472B1

(12) United States Patent
Fleenor

(10) Patent No.: US 8,381,472 B1
(45) Date of Patent: Feb. 26, 2013

(54) SYSTEM AND METHOD FOR ADJOINING SIDING

(75) Inventor: Bobby E. Fleenor, Grove City, OH (US)

(73) Assignee: Exterior Portfolio, LLC, Columbus, OH (US)

( * ) Notice: Subject to any disclaimer, the term of this patent is extended or adjusted under 35 U.S.C. 154(b) by 219 days.

(21) Appl. No.: 12/818,136

(22) Filed: Jun. 17, 2010

(51) Int. Cl.
*E04F 13/08* (2006.01)

(52) U.S. Cl. ..... 52/459; 52/462; 52/464; 52/535; 52/748.1

(58) Field of Classification Search ..... 52/518–521, 52/459–462, 464, 466, 468, 523, 535, 748.1
See application file for complete search history.

(56) References Cited

U.S. PATENT DOCUMENTS

| | | | | |
|---|---|---|---|---|
| 1,589,675 | A | 6/1926 | Belding | |
| 1,728,934 | A | 9/1929 | Hogenson | |
| 2,188,090 | A | 1/1940 | Young | |
| 2,495,303 | A | 1/1950 | Wisniewski | |
| 2,830,546 | A | 4/1958 | Rippe | |
| 2,961,804 | A | 11/1960 | Beckman | |
| D196,230 | S | 9/1963 | Raftery et al. | |
| 3,110,130 | A | 11/1963 | Trachtenberg | |
| 3,159,943 | A | 12/1964 | Sugar et al. | |
| 3,233,382 | A | 2/1966 | Graveley, Jr. | |
| 3,246,436 | A | 4/1966 | Roush | |
| 3,289,365 | A | 12/1966 | McLaughlin et al. | |
| 3,289,380 | A | 12/1966 | Charniga, Jr. | |
| 3,325,952 | A | 6/1967 | Trachtenberg | |
| 3,327,446 | A | 6/1967 | Tracy | |
| D208,251 | S | 8/1967 | Facer | |
| 3,339,333 | A | 9/1967 | Kovalcik | |
| 3,387,418 | A | 6/1968 | Tyrer | |
| 3,399,916 | A | 9/1968 | Ensor | |
| 3,468,086 | A | 9/1969 | Warner | |
| 3,473,274 | A | 10/1969 | Godes | |
| 3,520,099 | A | 7/1970 | Mattes | |
| 3,552,078 | A | 1/1971 | Mattes | |
| 3,555,762 | A | 1/1971 | Costanzo, Jr. | |
| 3,637,459 | A | 1/1972 | Parish et al. | |
| 3,650,080 | A * | 3/1972 | Leale, Sr. | 52/469 |
| 3,703,795 | A | 11/1972 | Mattes | |

(Continued)

FOREIGN PATENT DOCUMENTS

| | | |
|---|---|---|
| CA | 96829 | 8/2002 |
| CA | 2267000 | 4/2003 |

(Continued)

OTHER PUBLICATIONS

Sweet's General Building & Renovation, 1995 Catalog File; section 07460 on Siding, pp. 4-20.

(Continued)

*Primary Examiner* — William Gilbert
*Assistant Examiner* — Alp Akbasli
(74) *Attorney, Agent, or Firm* — Standley Law Group LLP

(57) ABSTRACT

A method and assembly for adjoining panels of building siding, that may include a first siding panel with a facing portion and a backing portion secured to the facing portion, a second siding panel with a facing portion and a backing portion secured to the facing portion, and an insert with a facing portion and a backing portion secured to the facing portion that is adapted to be installed between the backing portions of the first and second siding panels to create a butt seam installation.

20 Claims, 8 Drawing Sheets

U.S. PATENT DOCUMENTS

| | | | | | |
|---|---|---|---|---|---|
| 3,807,103 | A | * | 4/1974 | Kautz et al. | 52/58 |
| 3,815,310 | A | | 6/1974 | Kessler | |
| 3,826,054 | A | | 7/1974 | Culpepper, Jr. | |
| 3,895,087 | A | | 7/1975 | Ottinger et al. | |
| 3,969,866 | A | | 7/1976 | Kyne | |
| 3,970,502 | A | | 7/1976 | Turner | |
| 3,977,145 | A | * | 8/1976 | Dobby et al. | 52/531 |
| 3,998,021 | A | | 12/1976 | Lewis | |
| 4,001,997 | A | | 1/1977 | Saltzman | |
| 4,033,802 | A | | 7/1977 | Culpepper, Jr. et al. | |
| 4,034,528 | A | | 7/1977 | Sanders et al. | |
| 4,048,101 | A | | 9/1977 | Nakamachi et al. | |
| 4,081,939 | A | | 4/1978 | Culpepper, Jr. et al. | |
| 4,096,011 | A | | 6/1978 | Sanders et al. | |
| 4,102,106 | A | | 7/1978 | Golder et al. | |
| 4,104,841 | A | | 8/1978 | Naz | |
| 4,118,166 | A | | 10/1978 | Bartrum | |
| 4,154,040 | A | | 5/1979 | Pace | |
| 4,188,762 | A | | 2/1980 | Tellman | |
| 4,189,885 | A | | 2/1980 | Fritz | |
| 4,272,576 | A | | 6/1981 | Britson | |
| 4,274,236 | A | | 6/1981 | Kessler | |
| 4,279,106 | A | | 7/1981 | Gleason et al. | |
| 4,280,311 | A | | 7/1981 | Lockard | |
| 4,319,439 | A | | 3/1982 | Gussow | |
| 4,320,613 | A | | 3/1982 | Kaufman | |
| 4,327,528 | A | | 5/1982 | Fritz | |
| 4,352,771 | A | | 10/1982 | Szabo | |
| 4,389,824 | A | | 6/1983 | Anderson | |
| 4,424,655 | A | | 1/1984 | Trostle | |
| 4,429,503 | A | | 2/1984 | Holliday | |
| 4,432,181 | A | * | 2/1984 | Funaki | 52/459 |
| 4,450,665 | A | | 5/1984 | Katz | |
| D274,947 | S | | 7/1984 | Culpepper, Jr. et al. | |
| 4,492,064 | A | | 1/1985 | Bynoe | |
| 4,506,486 | A | | 3/1985 | Culpepper, Jr. et al. | |
| 4,593,512 | A | | 6/1986 | Funaki | |
| 4,608,800 | A | | 9/1986 | Fredette | |
| 4,649,008 | A | | 3/1987 | Johnstone et al. | |
| 4,680,911 | A | | 7/1987 | Davis et al. | |
| D291,249 | S | | 8/1987 | Manning | |
| 4,694,628 | A | | 9/1987 | Vondergoltz et al. | |
| 4,709,519 | A | | 12/1987 | Liefer et al. | |
| 4,716,645 | A | | 1/1988 | Pittman et al. | |
| 4,782,638 | A | | 11/1988 | Hovind | |
| 4,814,413 | A | | 3/1989 | Thibaut et al. | |
| 4,843,790 | A | | 7/1989 | Taravella | |
| 4,856,975 | A | | 8/1989 | Gearhart | |
| 4,864,788 | A | | 9/1989 | Tippmann | |
| 4,911,628 | A | | 3/1990 | Heilmayr et al. | |
| 4,920,709 | A | | 5/1990 | Garries et al. | |
| 4,930,287 | A | | 6/1990 | Volk et al. | |
| 4,932,184 | A | * | 6/1990 | Waller | 52/535 |
| 4,955,169 | A | | 9/1990 | Shisko | |
| 4,962,622 | A | | 10/1990 | Albrecht et al. | |
| 4,969,302 | A | | 11/1990 | Coggan et al. | |
| D316,299 | S | | 4/1991 | Hurlburt | |
| 5,014,476 | A | * | 5/1991 | Leslie et al. | 52/220.2 |
| 5,016,415 | A | | 5/1991 | Kellis | |
| 5,022,204 | A | | 6/1991 | Anderson | |
| 5,022,207 | A | | 6/1991 | Hartnett | |
| 5,024,045 | A | | 6/1991 | Fluent et al. | |
| 5,050,357 | A | | 9/1991 | Lawson | |
| 5,060,444 | A | | 10/1991 | Paquette | |
| 5,080,950 | A | | 1/1992 | Burke | |
| 5,090,174 | A | | 2/1992 | Fragale | |
| 5,103,612 | A | | 4/1992 | Wright | |
| 5,181,353 | A | * | 1/1993 | Harrington, Jr. | 52/79.1 |
| 5,224,315 | A | | 7/1993 | Winter, IV | |
| 5,230,377 | A | | 7/1993 | Berman | |
| D342,579 | S | | 12/1993 | Mason | |
| 5,282,344 | A | | 2/1994 | Moore | |
| 5,303,525 | A | | 4/1994 | Magee | |
| 5,306,548 | A | | 4/1994 | Zabrocki et al. | |
| 5,318,737 | A | | 6/1994 | Trabert et al. | |
| 5,347,784 | A | | 9/1994 | Crick et al. | |
| 5,355,649 | A | * | 10/1994 | Berridge | 52/520 |
| 5,363,623 | A | | 11/1994 | King | |
| 5,387,381 | A | | 2/1995 | Saloom | |
| 5,415,921 | A | | 5/1995 | Grohman | |
| D361,138 | S | | 8/1995 | Moore et al. | |
| 5,443,878 | A | | 8/1995 | Treloar et al. | |
| 5,461,839 | A | | 10/1995 | Beck | |
| 5,465,486 | A | | 11/1995 | King | |
| 5,465,543 | A | | 11/1995 | Seifert | |
| 5,475,963 | A | | 12/1995 | Chelednik | |
| 5,482,667 | A | | 1/1996 | Dunton et al. | |
| 5,502,940 | A | | 4/1996 | Fifield | |
| 5,537,791 | A | | 7/1996 | Champagne | |
| 5,542,222 | A | | 8/1996 | Wilson et al. | |
| 5,548,940 | A | | 8/1996 | Baldock | |
| 5,551,204 | A | | 9/1996 | Mayrand | |
| 5,553,434 | A | * | 9/1996 | Tamura | 52/545 |
| 5,560,170 | A | | 10/1996 | Ganser et al. | |
| 5,564,246 | A | | 10/1996 | Champagne | |
| 5,565,056 | A | | 10/1996 | Lause et al. | |
| 5,575,127 | A | | 11/1996 | O'Neal | |
| 5,581,968 | A | | 12/1996 | Laurie et al. | |
| 5,581,970 | A | | 12/1996 | O'Shea | |
| 5,586,415 | A | | 12/1996 | Fisher et al. | |
| 5,598,677 | A | | 2/1997 | Rehm, III | |
| 5,613,337 | A | | 3/1997 | Plath et al. | |
| 5,622,020 | A | | 4/1997 | Wood | |
| 5,628,158 | A | * | 5/1997 | Porter | 52/309.9 |
| 5,634,314 | A | | 6/1997 | Champagne | |
| 5,640,812 | A | * | 6/1997 | Crowley et al. | 52/90.1 |
| 5,651,227 | A | | 7/1997 | Anderson | |
| 5,661,939 | A | | 9/1997 | Coulis et al. | |
| 5,662,997 | A | | 9/1997 | Onishi et al. | |
| 5,664,376 | A | | 9/1997 | Wilson et al. | |
| 5,675,955 | A | | 10/1997 | Champagne | |
| 5,678,367 | A | | 10/1997 | Kline | |
| 5,694,728 | A | | 12/1997 | Heath, Jr. et al. | |
| 5,720,114 | A | | 2/1998 | Guerin | |
| 5,729,946 | A | | 3/1998 | Beck | |
| 5,737,881 | A | | 4/1998 | Stocksieker | |
| 5,765,333 | A | | 6/1998 | Cunningham | |
| 5,768,844 | A | | 6/1998 | Grace, Sr. et al. | |
| 5,775,042 | A | * | 7/1998 | Mowery et al. | 52/520 |
| 5,791,093 | A | | 8/1998 | Diamond | |
| 5,806,185 | A | | 9/1998 | King | |
| 5,809,731 | A | | 9/1998 | Reiss | |
| 5,829,206 | A | | 11/1998 | Bachman | |
| 5,836,113 | A | | 11/1998 | Bachman | |
| D402,770 | S | | 12/1998 | Hendrickson et al. | |
| 5,857,303 | A | | 1/1999 | Beck et al. | |
| 5,858,522 | A | | 1/1999 | Turk et al. | |
| 5,866,054 | A | | 2/1999 | Dorchester et al. | |
| 5,866,639 | A | | 2/1999 | Dorchester et al. | |
| 5,869,176 | A | | 2/1999 | Dorchester et al. | |
| 5,878,543 | A | | 3/1999 | Mowery | |
| 5,946,876 | A | | 9/1999 | Grace, Sr. et al. | |
| 5,956,914 | A | | 9/1999 | Williamson | |
| 5,974,756 | A | | 11/1999 | Alvarez et al. | |
| 6,029,415 | A | | 2/2000 | Culpepper et al. | |
| 6,035,587 | A | | 3/2000 | Dressler | |
| 6,047,507 | A | | 4/2000 | Lappin et al. | |
| 6,050,041 | A | | 4/2000 | Mowery et al. | |
| 6,055,787 | A | | 5/2000 | Gerhaher et al. | |
| 6,086,997 | A | | 7/2000 | Patel et al. | |
| D429,009 | S | | 8/2000 | Ginzel | |
| 6,122,877 | A | | 9/2000 | Hendrickson et al. | |
| 6,161,354 | A | | 12/2000 | Gilbert et al. | |
| 6,187,424 | B1 | | 2/2001 | Kjellqvist et al. | |
| 6,195,952 | B1 | | 3/2001 | Culpepper et al. | |
| 6,223,488 | B1 | | 5/2001 | Pelfrey et al. | |
| 6,233,890 | B1 | | 5/2001 | Tonyan | |
| 6,263,574 | B1 | | 7/2001 | Lubker, II et al. | |
| 6,272,797 | B1 | | 8/2001 | Finger | |
| D447,820 | S | | 9/2001 | Grace | |
| 6,282,858 | B1 | | 9/2001 | Swick | |
| D448,865 | S | | 10/2001 | Manning | |
| 6,295,777 | B1 | | 10/2001 | Hunter et al. | |
| D450,138 | S | | 11/2001 | Barber | |
| 6,321,500 | B1 | | 11/2001 | Manning et al. | |
| 6,336,988 | B1 | | 1/2002 | Enlow et al. | |
| 6,348,512 | B1 | | 2/2002 | Adriani | |

| | | | | |
|---|---|---|---|---|
| D454,962 | S | 3/2002 | Grace | |
| 6,358,585 | B1 | 3/2002 | Wolff | |
| 6,360,508 | B1 | 3/2002 | Pelfrey et al. | |
| 6,363,676 | B1 | 4/2002 | Martion, III | |
| 6,367,220 | B1 | 4/2002 | Krause et al. | |
| 6,393,792 | B1 | 5/2002 | Mowery et al. | |
| 6,442,912 | B1 | 9/2002 | Phillips et al. | |
| 6,451,398 | B1 | 9/2002 | Sylvester | |
| 6,516,577 | B2 | 2/2003 | Pelfrey et al. | |
| D471,292 | S | 3/2003 | Barber | |
| 6,526,718 | B2 | 3/2003 | Manning et al. | |
| 6,539,675 | B1 | 4/2003 | Gile | |
| 6,590,004 | B1 | 7/2003 | Zehner | |
| 6,594,965 | B2 | 7/2003 | Coulton | |
| 6,625,939 | B1 | 9/2003 | Beck et al. | |
| D481,804 | S | 11/2003 | Pelfrey | |
| 6,673,868 | B2 | 1/2004 | Choulet | |
| 6,716,522 | B2 | 4/2004 | Matsumoto et al. | |
| 6,752,941 | B2 | 6/2004 | Hills | |
| 6,784,230 | B1 | 8/2004 | Patterson et al. | |
| 6,865,849 | B1 | 3/2005 | Mollinger et al. | |
| 6,886,301 | B2 | 5/2005 | Schilger | |
| 6,971,211 | B1 | 12/2005 | Zehner | |
| 6,988,345 | B1 | 1/2006 | Pelfrey et al. | |
| 7,040,067 | B2 | 5/2006 | Mowery et al. | |
| 7,186,457 | B1 | 3/2007 | Zehner et al. | |
| 7,188,454 | B2 | 3/2007 | Mowery et al. | |
| 7,204,062 | B2 | 4/2007 | Fairbanks et al. | |
| 7,467,500 | B2 | 12/2008 | Fairbanks et al. | |
| 7,478,507 | B2 * | 1/2009 | Krause | 52/546 |
| 7,685,787 | B1 | 3/2010 | Mollinger et al. | |
| 7,698,864 | B2 * | 4/2010 | Justice et al. | 52/519 |
| 7,775,009 | B2 * | 8/2010 | King | 52/520 |
| 2001/0041256 | A1 | 11/2001 | Heilmayr | |
| 2002/0018907 | A1 | 2/2002 | Zehner | |
| 2002/0020125 | A1 | 2/2002 | Pelfrey et al. | |
| 2002/0025420 | A1 | 2/2002 | Wanat et al. | |
| 2002/0029537 | A1 | 3/2002 | Manning et al. | |
| 2002/0054996 | A1 | 5/2002 | Rheenen | |
| 2002/0056244 | A1 | 5/2002 | Hertweck | |
| 2002/0076544 | A1 | 6/2002 | DeWorth et al. | |
| 2002/0078650 | A1 | 6/2002 | Bullinger et al. | |
| 2002/0090471 | A1 | 7/2002 | Burger et al. | |
| 2002/0092256 | A1 * | 7/2002 | Hendrickson et al. | 52/519 |
| 2002/0108327 | A1 | 8/2002 | Shaw | |
| 2002/0177658 | A1 | 11/2002 | Tajima et al. | |
| 2003/0014936 | A1 | 1/2003 | Watanabe | |
| 2003/0056458 | A1 | 3/2003 | Black et al. | |
| 2003/0131551 | A1 | 7/2003 | Mollinger et al. | |
| 2003/0154664 | A1 | 8/2003 | Beck et al. | |
| 2004/0003566 | A1 | 1/2004 | Sicuranza | |
| 2004/0026021 | A1 | 2/2004 | Groh et al. | |
| 2004/0142157 | A1 | 7/2004 | Melkonian | |
| 2004/0211141 | A1 | 10/2004 | Sandy | |
| 2005/0081468 | A1 * | 4/2005 | Wilson et al. | 52/528 |
| 2005/0193674 | A1 * | 9/2005 | Hatkoff | 52/561 |
| 2006/0026920 | A1 | 2/2006 | Fairbanks et al. | |
| 2006/0053740 | A1 | 3/2006 | Wilson et al. | |
| 2006/0075712 | A1 | 4/2006 | Gilbert et al. | |
| 2006/0123729 | A1 | 6/2006 | Myers et al. | |
| 2007/0011966 | A1 * | 1/2007 | Justice et al. | 52/309.1 |
| 2009/0249729 | A1 * | 10/2009 | Thomas | 52/523 |
| 2010/0242398 | A1 * | 9/2010 | Cullen | 52/588.1 |

FOREIGN PATENT DOCUMENTS

| | | | |
|---|---|---|---|
| CL | 3.856 | | 5/2001 |
| DE | 40104760.1 | | 5/2001 |
| EP | 1086988 | A1 | 3/2001 |
| GB | 1068202 | | 5/1967 |
| GB | 2101944 | | 8/2001 |
| JP | 364001539 | A | 1/1989 |
| JP | 409141752 | A | 6/1997 |
| JP | 410018555 | A | 1/1998 |
| JP | 02001079951 | A | 3/2001 |
| KR | 321694 | | 3/2003 |
| PL | 4115 | | 7/2004 |
| WO | 00/55446 | A1 | 9/2000 |

OTHER PUBLICATIONS

Dupont Dow, "Adhesives", web site print outs from www.dupontdow.com, 1999, printed Aug. 12, 2000, 3 pages.

Dupont Dow, "Neoprene—Grades of Neoprene—AquaStikTM Water Based Polychloroprene.", web site print outs from www.dupontdow.com, 1999, printed Aug. 12, 2000, 2 pages.

Dupont Dow, "Neoprene—Grades of Neoprene—Neoprene Solid Grades for Solvent-Based Adhesives.", web site print outs from www.dupontdow.com, publication date not available, printed Aug. 12, 2000, 2 pages.

Crane Performance Siding, "New Craneboard solid core siding redefines home exterior siding," news release online, Mar. 20, 2001, 3 pages.

Weiker, Jim, "Crane puts new face on siding," The Columbus Dispatch, May 9, 2002, 3 pages.

Owens Corning, Innovations for Living, "What Do I Look for in Quality Vinyl Siding?", 1996-2002, printed Nov. 9, 2002, 1 page.

Building Products, Crane in the News, International Builders' Show Preview, Jan./Feb. 2003, 1 page.

Feirer, Mark, "Vinyl Siding, Love it or hate it, plastic is here to stay," This Old House Online, 2003, 8 pages, The Time4 Media Company.

* cited by examiner

SYSTEM AND METHOD FOR ADJOINING SIDING

CROSS-REFERENCE TO RELATED APPLICATIONS

This application claims the benefit of no other prior applications.

INVENTIVE FIELD

Exemplary embodiments are directed to a system and method of adjoining siding. More particularly, exemplary embodiments are directed to a system and method of adjoining siding panels with or without foam backing wherein the common (i.e., opposing) edges of two adjacent panels abut or substantially abut.

BACKGROUND AND SUMMARY

Since the introduction of vinyl siding into the market place, the traditional installation includes the use of lap joints between adjacent panels in order to maintain product continuity horizontally along the application wall. The lap joint requires the installer to lay one end of the vinyl panel over the surface of the adjacent panel. While a lap joint is an effective method for adjoining siding panels in terms of developing a continuous barrier between the external elements and the substrate wall, it can detract from the look of the overall installation because of the shadow lines created as a function of the mismatch in elevation inherent with a typical lap joint. Given that one intent of vinyl siding may be to imitate conventional wood claddings, the lapped seam detracts from this look due to the fact that wood claddings are not lapped horizontally with adjacent pieces. There is a reduction in aesthetic appeal because the adjacent panels are overlapping and not parallel, as would be found in a conventional wood cladding installation.

In the foam backed case, structural benefits gained through the use of an adhesive layer bonding the vinyl to the foam are reduced because the adhesive layer must include a set-back from the edge of the foam board to facilitate the formation of a lap joint. The glue set-back is necessary for lap joints given the lower panel must be inserted between the vinyl and foam of the adjacent panel. When exposed to radiant energy, the upper panel can distort and create a gap between the upper and lower panels, which detracts from the look of the assembly.

Another problem related to typical lapped seams stems from the fact the nested part fit between the top and bottom panels is not optimized because the curvature of the each panel is the same and does not include an offset to compensate for wall thickness. Furthermore, known lapped seams may inherently include an additional drawback due to the fact that the edges of the top panel are exposed. Additionally, variations in color from adjoining panels may make the seams more apparent further detracting from the look of the panel.

Yet another problem with known lapped seams is that siding exposed to high temperatures may cause the seams to warp or open. In addition to detracting from the product appearance, the product is also subject to damage from high winds due to deflection caused by the wind against the inside surface of a panel potentially causing the panel to tear away from the structure. Inherently, a known lapped seam is susceptible to wind damage because one end of adjacent panels is overlapped over the other adjacent siding panel. This known susceptibility is only exacerbated when the siding panel is warped by exposure to high temperatures or from other causes.

Consequently, it is understood that there is a need for a system and method of adjoining siding panels with or without foam backing wherein the common (i.e., opposing) edges of two adjacent panels abut or substantially abut, creating a more aesthetic appeal than overlapping panels by reducing the shadow line and creating a joint which better emulates the seam developed with traditional exterior claddings. Furthermore, a system and method for adjoining siding panels is desired that may be more cost effective because adjoined panels do not overlap, reducing the amount of paneling used during installation. Additionally, a siding panel system and method may be preferred that reduces risk exposure to wind damage since the abutting panels decrease the likelihood for wind to creep between the adjoining panels. Moreover, a system and method is needed to allow for adhesive or other adjoining devices to be applied to the entire surface of the foam backing of adjoining paneling units, which may reduce the likelihood of gaps developing at the seams due to the introduction of radiant energy.

Exemplary embodiments of the present invention are directed to systems and methods of adjoining siding. More particularly, exemplary embodiments include, but are not limited to, a system and method of adjoining vinyl siding panels, with or without foam backing, wherein the common (i.e., opposing) edges of two adjacent panels abut or substantially abut.

Exemplary embodiments may address some or all of the aforementioned concerns regarding the method of lap seaming adjacent panels when installing the parts on a structure (e.g., along a horizontal course). In exemplary embodiments, a first panel may be applied to a wall (e.g., such as according to the current state of the art). Prior to installing the second panel, an insert, which may be fabricated from the same material (e.g., in composite or hollow back form) with double side tape or another adhesive, is positioned next to the base (i.e., first) panel. In particular, after exposing, if necessary, the adhesive on a top side of the insert, the insert may be installed against the base panel such that the end of the base panel is over approximately half the width of the insert in one exemplary embodiment of the invention. The adjacent panel may be aligned with the base panel and butted such that the edge of the adjacent panel is against or substantially against the edge of the base panel creating one vertical seam. In one exemplary embodiment, the insert may be no longer exposed given that approximately one half of each side of this insert is covered by the ends of the two seamed siding panels. In an exemplary embodiment, the adjacent panel may be affixed to the wall per a standard installation method. An individual may use a roller or other compression device to facilitate the compression of the completed vertical seam in order to optimize the chemical or adhesive bond during exemplary embodiments of the installation method.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
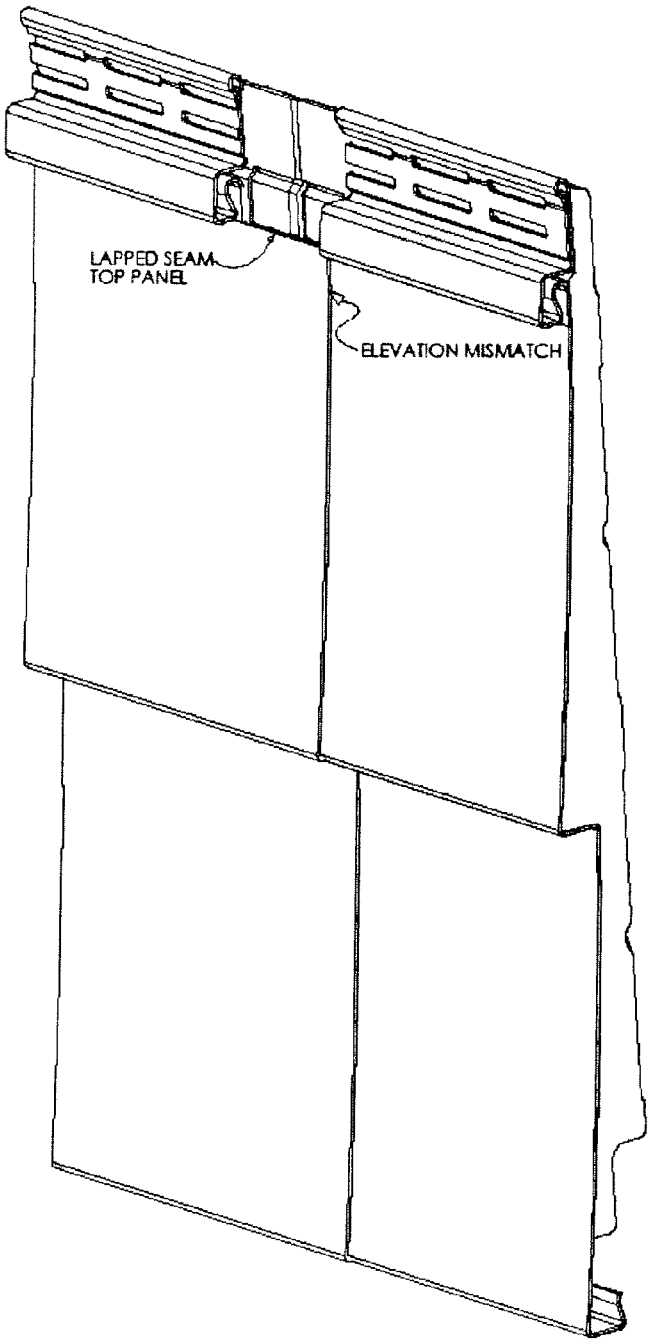
FIG. 1 is a perspective view of vinyl siding connected with the use of a traditional lap seam.

As seen in FIG. 1, traditionally vinyl siding installation includes the use of lap joints between adjacent panels in order to maintain product continuity horizontally along the application wall. The lap joint requires the installer to lay one end of the vinyl panel over the surface of the adjacent panel. While a lap joint may be a somewhat effective method for adjoining siding panels in terms of developing a continuous barrier between the external elements and the substrate wall, it can detract from the look of the overall panel because of the shadow lines created as a function of the mismatch in elevation inherent with a lap joint. Additionally, the use of an adhesive layer bonding the vinyl to the foam in a traditional lap joint is reduced because the adhesive layer must include a setback from the edge of the foam board to facilitate the development of a lap joint. The glue set-back is necessary for lap joints given the lower panel must be inserted between the vinyl and foam of the adjacent panel, as indicated in FIG. 1. Typically, when lapped panels are exposed to radiant energy, the upper panel may distort and create a gap between the upper and lower panels, which detracts from the look of the assembly.

Figure 2:
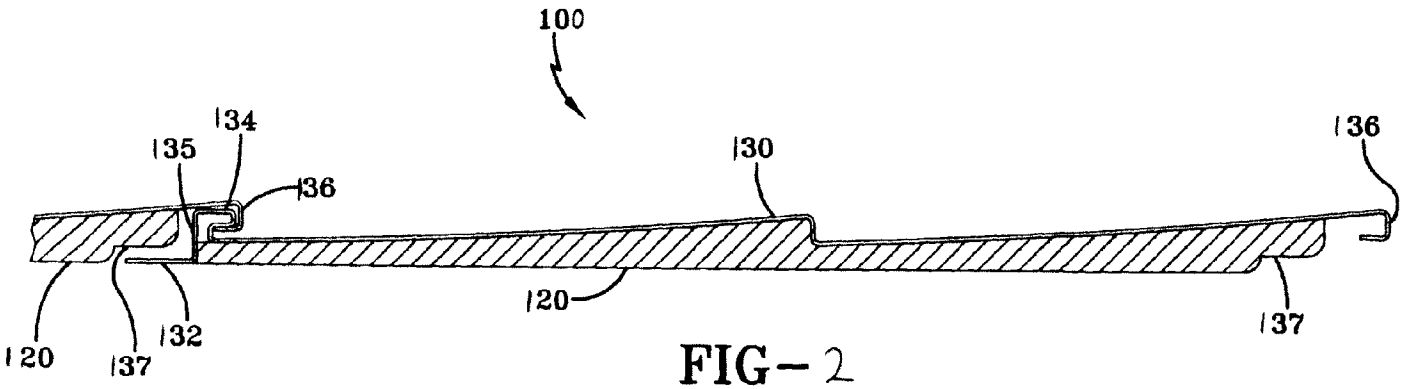
FIG. 2 is a right side plan view of two ends of vinyl siding with a lap seam to connect the top and bottom panels that may be used in an exemplary embodiment of the system.
Figure 3:
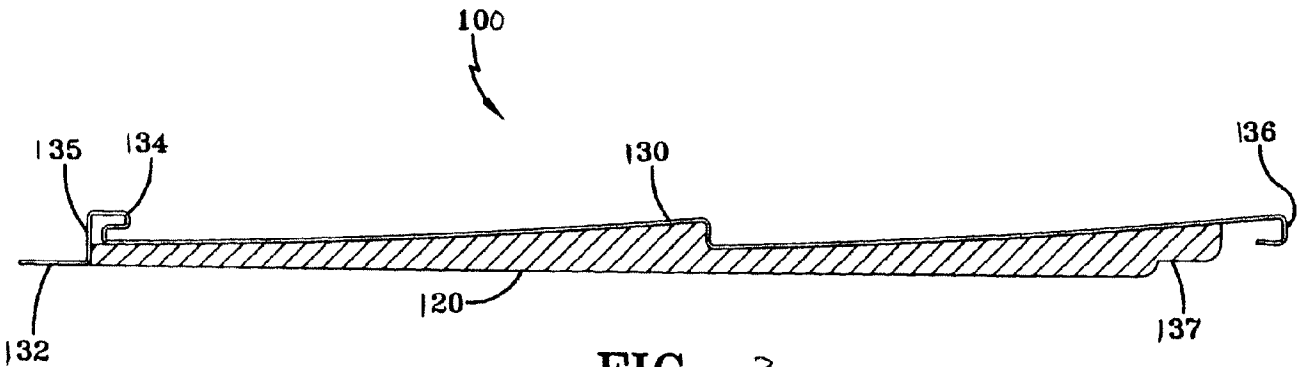
FIG. 3 is a right side plan view of the base panel of FIG. 2.

FIGS. 2 and 3 illustrate exemplary embodiments of a backed paneling unit used in an assembly and corresponding method of use. FIG. 2 depicts a siding unit 100 with two rows of siding. Nevertheless, it should be understood that a paneling unit of exemplary embodiments may be manufactured with any desired number of rows or sections. Furthermore, FIGS. 2 and 3 depict only one example of a backed paneling unit that may be used in the system and corresponding method of use (e.g., different elevations and profiles are possible). In other examples, other backed paneling units may be incorporated in the system and corresponding method of use, including, but not limited to, those found in U.S. application Ser. No. 11/745,955.

In FIGS. 2 and 3, the exemplary siding unit 100 includes backing portion 120 and at least one facing or cover panel or portion 130. For example, the backing portion 120 may be comprised of a base of either expanded or extruded polystyrene foam. However, it should be recognized that the backing portion 120 may be comprised of any sufficiently rigid material, including, but not limited to, foam, fiberglass, cardboard, and other similar, suitable, or conventional materials. Any suitable means may be used to obtain the shape of the backing portion 120. In an exemplary embodiment, the shape of the backing portion 120 may be obtained by molding, extrusion through a predetermined die configuration, and/or by cutting such as with a power saw or other cutting devices.

The backing portion 120 may be glued or otherwise laminated or attached to the inside of the cover panel 130. For example, an adhesive may be used to bond a portion of a backed portion 120 to a portion of the inside of a facing panel 130.

In addition, the facing portion 130 may include an attachment strip 132 (e.g., a nailing strip), a tongue 134, and a groove 136. The facing panel 130 may have a portion 135 that rearwardly extends to attachment strip 132. The portion 135, alone or in combination with attachment strip 132, may substantially cover the end or tip of the backing portion 120. More particularly, the portion 135 may wrap around and abut or be substantially adjacent to the end or tip of the backing portion 120. As a result, the portion 135 may protect the end or tip of the backing portion 120 from damage, particularly during shipping and installation. In this example, the attachment strip 132 is substantially in the same plane and parallel to an adjacent portion of the rear side of the backing portion 120. A channel 137 on the bottom portion of the backing portion 120 may be adapted to interlock with, overlap, and/or extend over the nailing strip 132 of the facing panel 130 of a substantially similar siding unit 100. The nailing strip (also called a nailing hem) 132 may have a plurality of openings for receiving fasteners. Nails or any other suitable mechanical fastening means may be extended through apertures in the nailing strip 132 in order to secure the facing panel 130 to a building structure. As is shown in FIG. 2, the tongue 134 is adapted to fit in the groove 136 of another siding panel when installed on a building structure. Likewise, the groove 136 is adapted to receive the tongue 134 of a substantially similar siding panel when installed on a building structure. The tongue-and-groove connection may also be referred to as a hanger section.

The top or face portion of the siding unit 100 may have a facing panel 130, which may substantially cover the backing portion 120. A benefit of this feature is that the backing portion 120 is protected from breakage that may occur in shipping, handling, or installation if not substantially covered with a facing panel 130.

Figure 4:
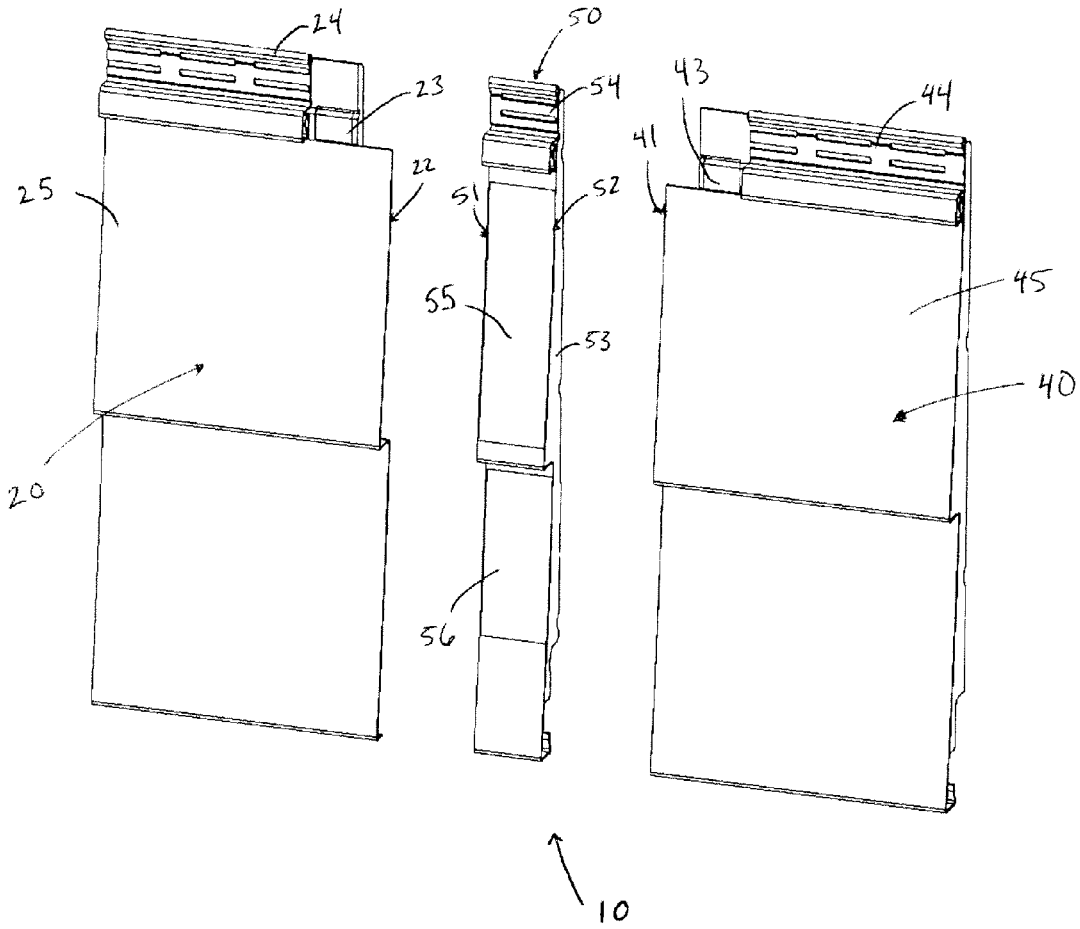
FIG. 4 is a perspective view depicting the exemplary components of an exemplary system and method to include an insert.
Figure 5:
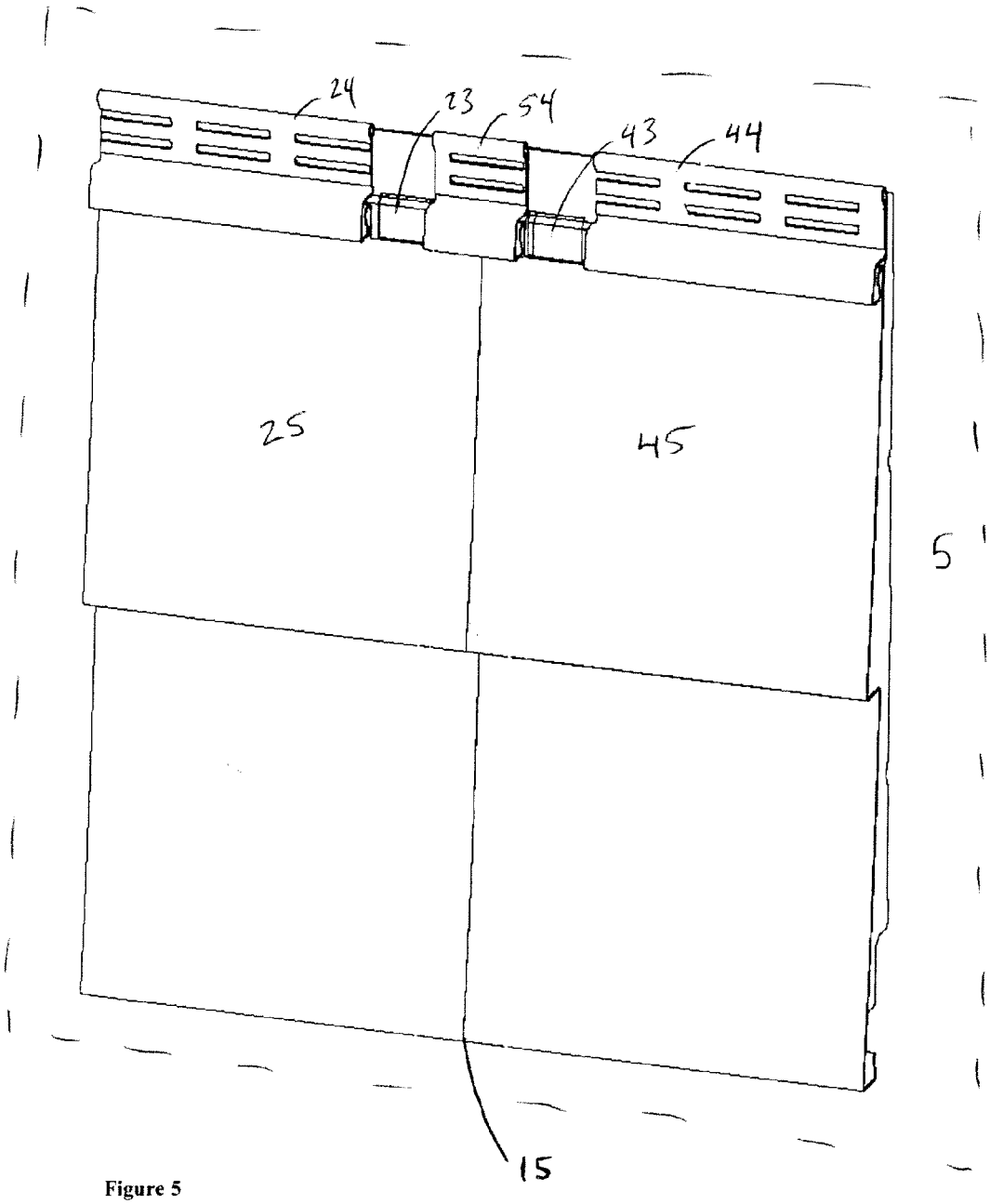
FIG. 5 is a perspective view of an exemplary embodiment of the system with two ends of vinyl siding with insulation, depicting an example of a final appearance of the system installed.

As seen in FIGS. 4 and 5, an exemplary embodiment of the assembly 10 and corresponding method of installation for vinyl siding may create a butt seam 15 between a base panel 20 and an adjacent (e.g., end) panel 40. As seen in FIGS. 4 and 5, the butt seam between the base panel 20 and the adjacent panel 40 may simultaneously provide a protective barrier between a substrate wall 5 and environmental elements as well as provide a more aesthetic final product appearance, particularly in an embodiment when the elevation of the trailing edge 22 of the base panel 20 and the leading edge 41 of adjacent panel 40 are substantially the same.

Exemplary embodiments of the base panel 20 and the adjacent panel 40 may be fabricated from the aforementioned siding unit 100 and/or other desired siding units that may be modified in accordance with exemplary embodiments of the present invention. However, although some embodiments of the base panel 20 and the adjacent panel 40 may be fabricated by modifying traditional siding units, other embodiments may be fabricated from virgin or recycled materials.

Figure 6:
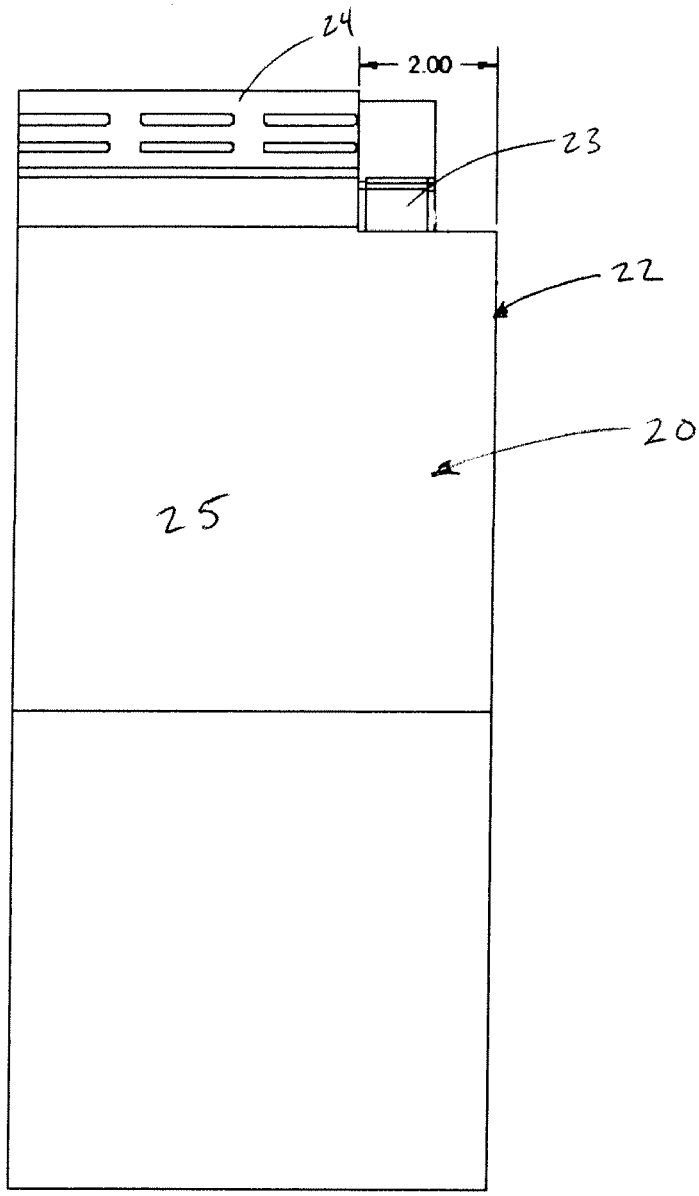
FIG. 6 is a front elevation view of an exemplary embodiment of a base panel.

As seen in FIGS. 4 and 6, a traditional siding unit may be modified to create a base panel 20. However, in other examples, an original siding unit may be fabricated instead of modifying a traditional siding unit. In the following discussion, it should be recognized that it is equally applicable to original panels or subsequently modified panels. In other words, modifying or removing portions of a panel may include a panel that is originally manufactured with such features (i.e., the modified or removed portions). In this example, the trailing edge 22 of the base panel 20 has been modified wherein at least a portion of the backing portion 23 is removed. In some examples, approximately 0-3 inches of the backing portion 23 from the trailing edge may be removed to facilitate the engagement of the corresponding portion of an insert 50. More specifically, in some examples, approximately ½-1 inch of the backing portion 23 from the trailing edge may be removed to facilitate the engagement of the corresponding portion of an insert 50. In one specific example, approximately ⅝ inch of the backing portion 23 from the trailing edge 22 is removed to facilitate the engagement of a corresponding portion of the insert 50.

Furthermore, in this example, at least a portion of the attachment strip 24 may be removed to facilitate the installation of the insert 50 with the base panel 20. In the example depicted in FIGS. 4 and 5, the trailing edge of the backing portion 23 may extend further towards the trailing edge of the facing portion, when compared to the trailing edge of the attachment strip 24. In this configuration, with the backcut of the nail hem retained, an installer may have the option of using the common methodology of a lap seam installation, or the butt seam installation method as described herein. If the backcut of the nail hem is removed, the installer may still use the butt seam installation method to install the assembly for any application.

However, in some examples, the portion of the attachment strip 24 that is modified and/or removed may be the same length as the portion of the backing portion 23 that is removed when measured from the trailing edge 22 of the facing panel 25. In this configuration, an exemplary cropping process may be expedited due to the need for only one cut during fabrication of an exemplary embodiment of the assembly 10.

Figure 7:
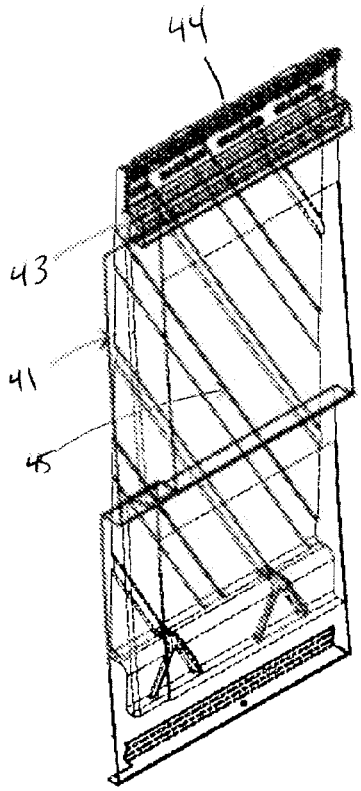
FIG. 7 is a perspective view of an exemplary embodiment of an end panel.
Figure 8:
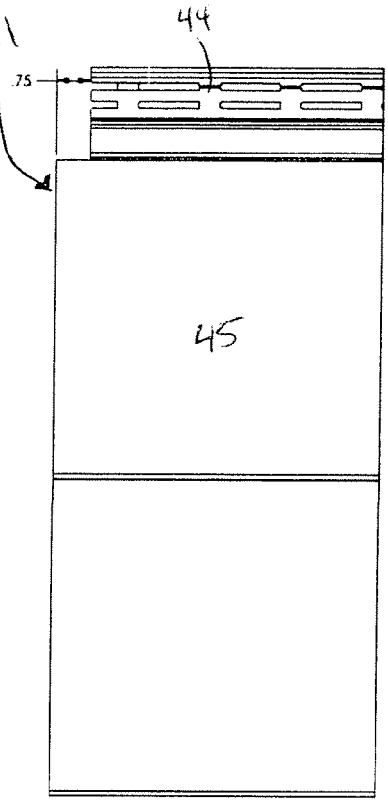
FIG. 8 is a front elevation view of an exemplary embodiment of an end panel.

As seen in FIGS. 4, 7 and 8 a traditional siding unit may be modified to create an adjacent panel 40. In this example, the leading edge 41 of the panel 40 has been modified wherein at least a portion of the backing portion 43 is removed. Furthermore, in this example, at least a portion of the attachment strip 44 may be removed to facilitate the installation of the insert 50 with the panel 40. In the example depicted in FIGS. 4 and 5, the leading edge of the backing portion 43 extends further towards the leading edge of the facing portion, when compared to the leading edge of the attachment strip 44. In some examples, approximately 0-3 inches of the backing portion 43 from the leading edge may be removed to facilitate the engagement of the corresponding portion of an insert 50. More specifically, in some examples, approximately ½-1 inches of the backing portion 43 from the leading edge may be removed to facilitate the engagement of the corresponding portion of an insert 50. In another specific example, approximately ⅝" of the backing portion 43 from the leading edge 41 is removed to facilitate the engagement of a corresponding portion of the insert 50.

However, in some examples, as seen in FIGS. 7 and 8, the portion of the attachment strip 44 that is modified and/or removed may be the same length as the portion of backing portion 43 that is removed when measured from the leading edge 41 of the facing panel 45. In this configuration, an exemplary cropping process may be expedited due to the need for only one cut during fabrication of an exemplary embodiment of the assembly 10. Furthermore, in some examples, the attachment strip 44 may not be modified and may extend substantially to the same length as the facing panel 45. In this arrangement, the extra length of the attachment strip 44 may facilitate a more resilient installation of the assembly because an installer may install a fastener closer to the leading edge 41 of the assembly.

In some exemplary embodiments of the assembly 10, the setback of the backing portion 23 and/or the attachment strip 24 from the edge of the facing panel 25 may be substantially the same distance(s) when compared to the corresponding setbacks of panel 40, creating ends of the panels that are substantially mirror-images of one another. If the setback(s) of the base panel 20 and panel 40 are substantially the same distance, it may allow an installer to approximately center the insert 50 during installation. However, in some embodiments, the setbacks of the leading and trailing edges of adjacent panels may be different such as due to variation in manufacturing. As such, exemplary embodiments of the insert may be sized to accommodate any setback(s) based on the sum total of the leading and trailing edge setbacks.

It should be recognized that an exemplary embodiment of a panel may include the aforementioned setbacks on each end of the panel. An example of such a panel may be one that is in an intermediate position in a horizontal installation of other panels. Such an embodiment may allow for the formation of a butt seam at each end of the panel.

Figure 9:
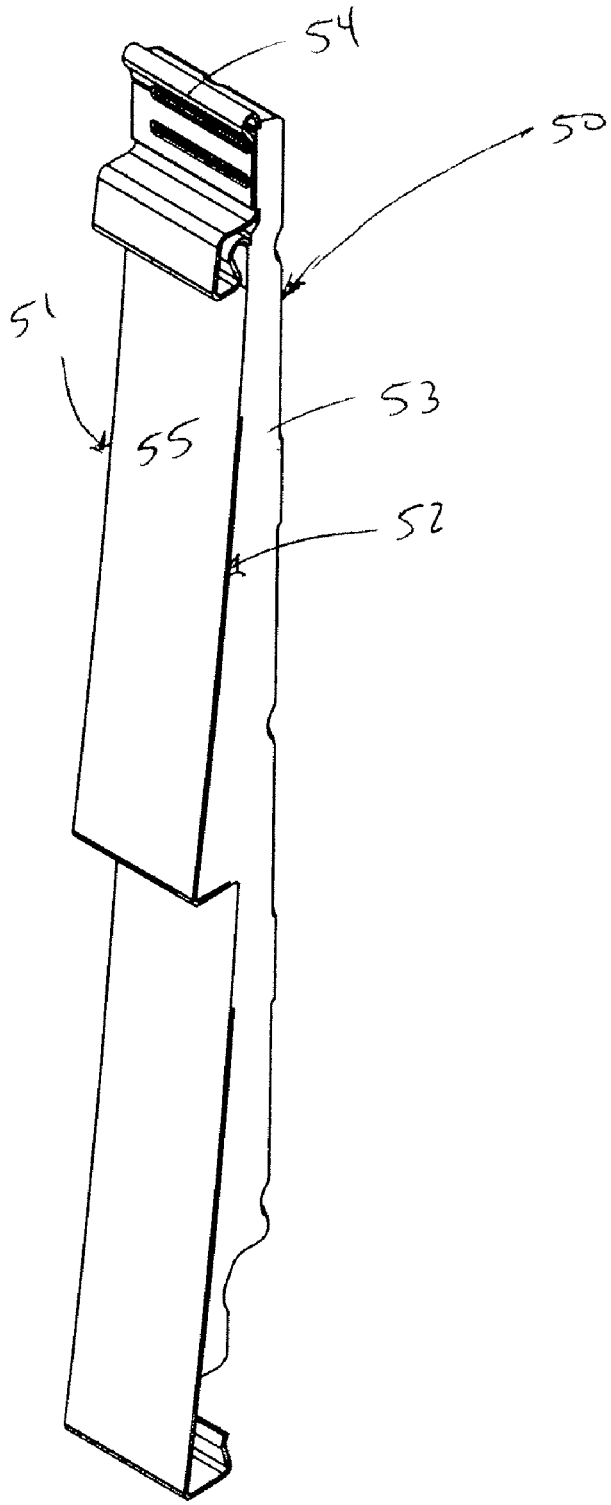
FIG. 9 is a perspective view of an exemplary embodiment of an insert.
Figure 10:
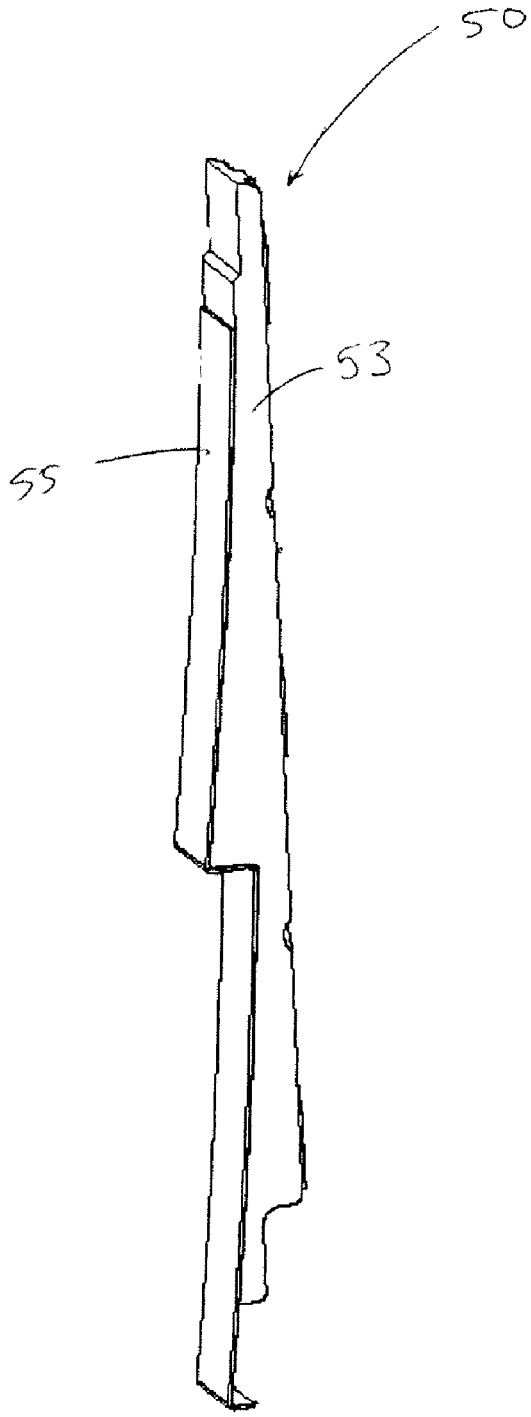
FIG. 10 is a perspective view of an exemplary embodiment of an insert.

Exemplary embodiments of the assembly 10 and associated method may include the use of an insert 50, such as depicted in FIGS. 9 and 10. Similar to exemplary embodiments of the base panels 20 and adjacent panels 40, examples of the insert 50 may be fabricated similarly to the aforementioned siding unit 100 and/or other traditional siding units that may be modified. However, although some embodiments of the insert 50 may be fabricated by modifying traditional siding units, other embodiments may be fabricated from virgin or recycled materials.

The insert 50 may vary in width, depending upon the geometry and size of the offset(s) in each of the base panel 20 and adjacent panel 40 used to develop the seam. In some embodiments, the width of the insert 50 may be substantially the same along the height of the insert 50. However, in other exemplary embodiments, the width of the insert 50 may vary along the height of the insert 50 to correspond with the setback(s) of the base panel 20 and adjacent panel 40.

To facilitate installation, exemplary embodiments of the assembly 10 may include examples of the base panel 20 wherein the geometry of at least a portion of the trailing edge of the backing portion 23 is fabricated to correspond to at least a portion of the leading edge 51 of the backing portion 53 of the insert 50. In some exemplary embodiments, the trailing edge 22 may be fabricated to engage the leading edge 41 of an adjacent panel. Furthermore, a portion of the trailing edge of the backing portion 23 may engage the leading edge of the adjacent backing portion 43 in some exemplary embodiments. Additionally, in some exemplary embodiments when installed, the facing portion or panel 55 of insert 50 may engage the facing panel 25 and/or 45.

Similarly, the assembly 10 may include examples of an adjacent panel 40 wherein the geometry of at least a portion of the leading edge 41 of the backing portion 43 is fabricated to correspond to at least a portion of the trailing edge 52 of the backing portion 53 of the insert 50. Furthermore, in some examples, the backside of the facing panel 55 may engage a textured side or edge of the insert 50. Additionally, the topside of the facing portion or panel 55 may engage the backside of adjacent facing panel 25 and/or 45, wherein the facing panels overhang the backing portions 23 and 43.

In some exemplary embodiments, at least a portion of the insert 50 may be covered with an adhesive 56. As depicted in FIG. 4, an adhesive may be adhered to exemplary embodiments of the facing portion or panel 55 such that the insert 50 may be secured to the back or rear side of facing panel 25 and/or facing panel 45. An example of the adhesive that may be used for installation is 3M double coated tape 9687C with PET liner. Furthermore, in some exemplary embodiments, the adhesive may be covered with a release liner (not shown) or other similar device that allows the adhesive to be adhered to the insert for transportation, etc. before the insert may be used during installation.

Additionally, in some exemplary embodiments, double side tape or a similar device may be used during the installation process to adhere the insert to the panels. By not adhering the double side tape to the insert and/or panels until installation occurs, it may allow for less expensive shipping and/or storage costs of the assembly 10. Furthermore, by not adhering the double side tape during fabrication of the insert 50 and/or panels, the manufacturing time and/or expense may be reduced.

In one example as seen in FIG. 9, the insert 50 may be fabricated by modifying a standard siding unit, such as the aforementioned siding unit 100, to a desired width. In this regard, an installer may use leftover or cut pieces of the aforementioned siding units 100 to fabricate exemplary embodiments of the insert. The insert 50 may include all of the components of a standard siding unit 100, such as, but not limited to: the backing portion 120 and the cover panel 130. In some examples, at least a portion of the cover panel 130 may be modified or removed from the insert 50 to facilitate installation of the insert between the base panel 20 and an adjacent panel 40. The exemplary embodiment depicted in FIG. 9 depicts an insert 50 wherein the cover panel 130 is not modified.

Exemplary embodiments of the method for installing vinyl siding may create a butt seam between adjoining panels, which simultaneously provides a protective barrier between the substrate wall and environmental elements as well as provides a more aesthetic final product appearance given the elevation of the trailing edge of the base panel and the leading edge of the adjacent panel are substantially the same. Exemplary embodiments of the assembly and method of installation may remedy the aforementioned concerns regarding the method of lap seaming adjacent panels when installing the parts on a structure along a given horizontal course.

Central to this exemplary installation method is the use of an insert 50, which may include an adhesive, such as double side tape, attached to at least a portion of the face panel. As prescribed by exemplary embodiments, the base panel may be applied to the wall such as defined by the current state of the art. In one example, prior to installing the adjacent panel, an insert, which may be made of the same material either in composite or hollow back form, with double side tape is positioned next to the base panel.

During one example of an installation, an individual may attach a strip of the double side tape to each course of the insert panel and/or the back or rear side of the facing panel(s) of adjacent paneling units. When the installer is ready to seam the adjoining panels, such as a base panel and an adjacent panel, the installer may remove the top layer of the tape, exposing the adhesive. The insert may then be placed next to the mounted panel (in this example, the base panel) such that the trailing edge of the backing portion of the base panel is engaging (e.g., abutting or substantially abutting) at least a portion of the leading edge of the backing portion of the insert, and the extended facing portion of base panel is positioned over substantially half of the insert. The installer may then compress the extended facing portion of the base panel against the insert using any number of devices, such as a roller, to optimize the chemical bond.

In some examples of the method, the insert may be secured to at least a portion of the underlying structure by an additional adhering or fastening device (not shown), such as a nail or fastener. Furthermore, in some examples, a thin insulating member (not shown) may be affixed or placed adjacent to at least a portion of the insert to improve the insulative properties of the assembly after installation, particularly in the scenario where the insert is too narrow in width to engage the backing portions of adjacent installed panels.

In some examples of the installation method, after the base panel has been adhered to the insert, the adjoining subsequent panel is aligned with the base panel and engaged such that the edge of the new panel is substantially against (e.g., abuts or substantially abuts) the edge of the base panel creating one vertical seam. Furthermore, in some examples of an installation, the adjoining panel is positioned such that the backing panel of the insert engages (e.g., abuts or substantially abuts) the backing panel of the adjoining panel, and the extending facing panels of each of the adjoining panels engage (e.g., abut or substantially abut) one another. After installation of the adjoining panel, at least a portion of the insert may be no longer exposed given the insert is at least partially covered by the ends of the two seamed and adjoining siding panels.

After the adjoining panel is positioned, the adjoining panel may be secured to the wall per a standard installation method. Once again, the installer may use a roller or other similar device to compress the extended facing portion of the adjoining panel to ensure that panel has been adequately compressed against the adhesive and the insert to optimize the bond. The net result may be a butt seam with a reinforced back, which may substantially prevent moisture from contacting the substrate wall, as well as provide compressive resistance, as depicted in FIG. 5.

Although the aforementioned exemplary method may depict the installation of the assembly from left to right, it should be known that exemplary embodiments of the assembly may be installed in a right to left manner, from the outside in, or from a common first panel outwardly. Also, in some exemplary embodiments, an insert may be first installed.

Other variations are also possible. For example, an insert may be specially manufactured or modified such that it has desired dimensions. For instance, an insert may be given a thickness (or outward dimension) to allow for an optimal butt seam. In other words, the thickness or outward dimension of the insert may be slightly less than that of the adjacent panel(s) to allow for an optimal butt seam. Also, an example of an insert may not include both a facing panel and backing portion. For example, an embodiment of an insert may be comprised of just backing portion or just a facing panel. In one example of an insert comprising just a backing portion, the adhesive or tape may be applied directly on the backing portion. In further examples, it should be recognized that portions of a backing portion and/or facing panel may be modified and/or removed. FIG. 10 shows an example in which an insert 50 does not have a tongue or nail hem. Also, in some embodiments, an adhesive may be applied to the back or rear side of a facing panel in addition to, or alternatively to, an adhesive on an insert prior to the facing panel being secured to the insert. Finally, it should be recognized that a facing panel may be comprised of vinyl, organic-filled composite, inorganic-filled composite, fiber cement, cement, wood, or any other suitable material.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. An assembly for adjoining panels of building siding, comprising:

a first siding panel with a leading edge and a trailing edge, and having a facing portion and a backing portion secured to the facing portion, wherein at least one said edge of the facing portion extends beyond an edge of the backing portion, creating a setback of the backing portion;

a second siding panel with a leading edge and a trailing edge, and having a facing portion and a backing portion secured to the facing portion, wherein at least one said edge of the facing portion extends beyond an edge of the backing portion that corresponds to the at least one said extending edge of the first siding panel, creating a setback of the backing portion; and an insert with a leading edge and a trailing edge, and having a facing portion and a backing portion secured to the facing portion, wherein the insert is adapted to be installed between the backing portions of the first and second siding panels;

wherein the width of the insert from the leading edge to the trailing edge is approximately the same amount as the total of the amount the at least one said edge of the facing portion of the first siding panel and the at least one said edge of the facing portion of the second siding panel extend beyond the edges of the respective backing portions.

2. The assembly of claim 1, further comprising an adhesive that is adhered to at least a portion of the facing portion of the insert.

3. The assembly of claim 2, wherein the adhesive is double side tape.

4. The assembly of claim 1, wherein:

the respective facing portions of the first and second siding panels each include an attachment strip situated at an upper edge of each facing portion;

the attachment strip of the first siding panel is substantially the same distance as the backing portion from the trailing edge of the facing portion of the first siding panel; and the attachment strip of the second siding panel is substantially the same distance as the backing portion from the leading edge of the facing portion of the second siding panel.

5. The assembly of claim 1, wherein the respective setback of each said backing portion is substantially the same distance from both the trailing edge of the first siding panel and the leading edge of the second siding panel, creating ends of the panels that are substantially mirror-images of one another.

6. The assembly of claim 1, wherein the width of the insert is substantially the same along the height thereof.

7. The assembly of claim 1, wherein:

at least a portion of the trailing edge of the backing portion of the first siding panel is adapted to engage at least a portion of the leading edge of the backing portion of the insert when installed; and at least a portion of the trailing edge of the facing portion of the first siding panel is adapted to engage the leading edge of the facing portion of the second siding panel when installed.

8. The assembly of claim 1, wherein when installed, at least a portion of the facing portion of the insert engages at least a portion of the respective rear sides of the facing portions of the first and second siding panels.

9. An assembly for adjoining panels of building siding, comprising:

a first siding panel with a leading edge and a trailing edge, and having a facing portion and a backing portion secured to the facing portion, wherein at least one said edge of the facing portion extends beyond an edge of the backing portion, creating a setback of the backing portion;

a second siding panel with a leading edge and a trailing edge, and having a facing portion and a backing portion secured to the facing portion, wherein at least one said edge of the facing portion extends beyond an edge of the backing portion that corresponds to the at least one said extending edge of the first siding panel, creating a setback of the backing portion;

an insert with a leading edge and a trailing edge, and having a facing portion and a backing portion secured to the facing portion, wherein the insert is adapted to be installed between the backing portions of the first and second siding panels; and an adhesive adhered to at least a portion of the facing portion of the insert;

wherein the facing portions of the first and second siding panels each include an attachment strip situated at an upper edge of each facing portion such that the distance of the attachment strip of the first siding panel from the trailing edge of the facing portion of the first siding panel is substantially the same distance as the attachment strip of the second siding panel from the leading edge of the facing portion of the second siding panel, creating a setback of each attachment strip.

10. The assembly of claim 9, wherein the respective setbacks of the backing portion and the attachment strip from the edge of the facing portion may be substantially the same from both the trailing edge of the first siding panel and the leading edge of the second siding panel, creating ends of the panels that are substantially mirror-images of one another.

11. The assembly of claim 9, wherein:

at least a portion of the trailing edge of the backing portion of the first siding panel is adapted to engage at least a portion of the leading edge of the backing portion of the insert when installed;

at least a portion of the trailing edge of the facing portion of the first siding panel is adapted to engage the leading edge of the facing portion of the second siding panel when installed, and when installed, at least a portion of the facing portion of the insert engages at least a portion of the respective rear sides of the facing portions of the first and second siding panels.

12. A method for adjoining panels of building siding, comprising the steps of:

providing an assembly as described in claim 1;

installing the first siding panel to a structure;

providing an insert having a facing portion at least partially covered by an adhesive;

positioning the insert next to the first siding panel such that the trailing edge of the backing portion of the first siding panel engages at least a portion of the leading edge of the backing portion of the insert, and the facing portion of the first siding panel is positioned over at least a portion of the facing portion of the insert; and aligning the second siding panel with the first siding panel such that the leading edge of the facing portion of the second siding panel engages the trailing edge of the facing portion of the first siding panel, creating a vertical seam.

13. The method of claim 12, further comprising the step of removing a liner from over the adhesive before installing the insert.

14. The method of claim 12, further comprising the step of compressing the facing portion of the first siding panel against the insert.

15. The method of claim 12, further comprising the step of compressing the facing portion of the second siding panel against the insert.

16. The method of claim 12, wherein the facing portion of the first siding panel is positioned over substantially half of the insert.

17. The method of claim 12, further comprising the step of adhering the insert to at least a portion of the structure by a fastening device.

18. The method of claim 12, further comprising the step of positioning the second siding panel such that the backing portion of the second siding panel engages the backing portion of the insert.

19. The method of claim 12, further comprising the step of installing the second siding panel to the structure.

20. The method of claim 12, wherein the insert is fabricated by modifying a standard siding unit.

* * * * *